United States Patent [19]

Casull

[11] 4,450,992

[45] May 29, 1984

[54] BELT BUCKLE-MINI-REVOLVER COMBINATION

[76] Inventor: Richard J. Casull, P.O. Box 276, Freedom, Wyo. 83120

[21] Appl. No.: 409,546

[22] Filed: Aug. 19, 1982

[51] Int. Cl.[3] ..... A44B 11/00; A45C 11/00

[52] U.S. Cl. ..... 224/163; 224/243; 224/912; 224/249; 24/163 K; D2/400; D22/14

[58] Field of Search ..... 24/163 R, 163 K; 46/1 E; 211/64; 42/1 J, 1 K, 54; 224/163, 195, 224, 225, 243, 271, 912, 249; D22/13, 14; D2/400, 406

[56] References Cited

U.S. PATENT DOCUMENTS

| | | | |
|---|---|---|---|
| 252,448 | 1/1882 | Flatau | 224/912 X |
| 3,026,642 | 3/1962 | Ryan | 46/1 E |
| 4,260,087 | 4/1981 | Leaver | 24/163 K X |
| 4,377,249 | 3/1983 | Bockoven | 224/163 |

FOREIGN PATENT DOCUMENTS

| | | | |
|---|---|---|---|
| 764910 | 5/1934 | France | 224/163 |

*Primary Examiner*—Robert P. Swiatek
*Attorney, Agent, or Firm*—B. Deon Criddle

[57] ABSTRACT

A belt buckle is disclosed which has an indented area on the front face of the buckle that is shaped and adapted for reception of a small handgun flatwise therein. The handgun is held within the indented area so that the entire side of the handgun is exposed to give ornamentation to the buckle. Apparatus is provided for releasably securing the handgun to the buckle, whereby the handgun can be quickly and easily removed from and reattached to the buckle.

6 Claims, 6 Drawing Figures

BELT BUCKLE-MINI-REVOLVER COMBINATION

BACKGROUND OF THE INVENTION

1. Field

The invention pertains to ornamental belt buckles and in particular to a belt buckle which is adapted for releasable mounting of a small handgun thereto, wherein the handgun is at least part of the ornamentation for the buckle.

2. State of the Art

Ornamental belt buckles of various kinds and shapes have been employed. Holsters have long been used to carry a handgun on a belt around the hips of a person. However, to the best of my knowledge, there has been no suggestion of using a small handgun as a decorative element of a belt buckle, wherein the handgun can be quickly and easily removed from the belt buckle for shooting or other various reasons and then replaced as an ornamental feature of the buckle.

3. Objective

A principal objective of the present invention is to provide a belt buckle which is adapted to have a handgun releasably mounted thereon. A further objective is to provide such a belt buckle in which one entire side of the handgun is visible from the front of the buckle when the handgun is mounted on the buckle.

SUMMARY OF THE INVENTION

The above objectives are achieved in accordance with the present invention by providing a belt buckle which is adapted to have a small handgun releasably mounted to the front face of the buckle. The buckle comprises a buckle plate having an indented area on the front face thereof, with the indented area being shaped for reception of a small handgun flatwise within the indented area. The means for releasably securing the handgun to the buckle preferably comprises a spring clasp means which is adapted to engage the handgun when the handgun is positioned within the indented area of the buckle plate. Release means are provided in combination with the spring clasp. The release means preferably comprises a push button on the face of the buckle, with the push button being adapted to release the spring clasp when the push button is depressed.

Additional objects and features of the invention will become apparent from the following detailed description, taken together with the accompanying drawings.

THE DRAWINGS

A particular embodiment of the present invention representing the best mode presently contemplated of carrying out the invention is illustrated in the accompanying drawings, in which.

DETAILED DESCRIPTION OF THE ILLUSTRATED EMBODIMENT

Figure 1:
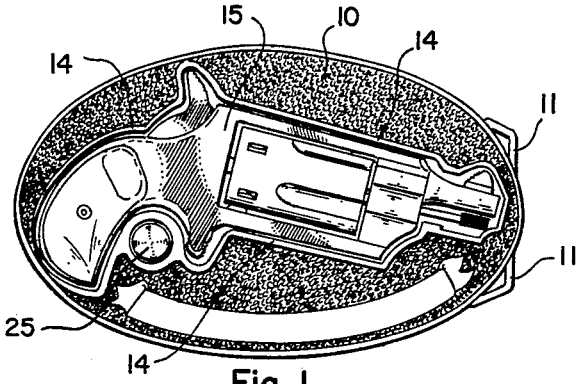
FIG. 1 is a front elevation of the belt buckle in accordance with the invention.

A preferred embodiment of the belt buckle in accordance with this invention is shown in the drawings. The buckle is of the well-known Western type buckle comprising a buckle plate 10 having a belt retaining loop member 11 at one side thereof for attachment of a belt, with a hook or prong member 12 at the other side for engaging holes or openings in the belt. Such type buckles are well known in the art and a great many variations in the decorative features of the buckle have been utilized.

In accordance with the present invention; the buckle plate is provided with an indented area 14 on the front face thereof. The indented area 14 has the shape of a small handgun 15 and is adapted for reception of the small handgun 15 flatwise therein.

Means are provided for releasably securing the small handgun 15 to the buckle plate 10 within the indented area 14 so that one flatwise side of the handgun 15 is exposed in its entirety and faces outwardly from the front face of the buckle plate 10. In the preferred, illustrated embodiment, the means for releasably securing the small handgun 15 within the indented area 14 comprises an opening 16 in the indented portion of the buckle plate 10, wherein the opening 16 is adapted to receive a stud 17 which is attached to and extends from the side frame of the handgun 15. A spring clasp means is attached to the back face of the buckle plate 10 and positioned adjacent to the opening 16. The spring clasp means is adapted to releasably engage the free end of the stud 17 of the handgun 15 when the handgun 15 is positioned in the indented area 14 so that the stud 17 is received through the opening 16.

The spring clasp means of the preferred, illustrated embodiment comprises a split spring pin 18 which is formed from spring wire. The spring wire is bent back upon itself to provide two wire spring legs which extend in parallel, closely spaced relationship. The split spring pin 18 is attached to the back face of the buckle plate 10 so as to lie flat adjacent the back face, with the two wire spring legs thereof passing over the opening 16 as best shown in FIG. 6. The wire spring legs must be positioned over the opening 16 so that they can engage the stud 17 of the handgun 15 when the stud 17 is received in the opening 16. To aid in the positioning of the spring legs of the split spring pin 18 and the retention of the spring legs in proper position over the opening 16, the bent back portion of the split spring pin 18 can have a turned back portion 19 which is bent at a right angle to the plane in which the two wire spring legs extend. A corresponding recess 20 is formed in the back face of the buckle plate 10 to receive the turned back portion 19 of the split spring pin 18.

Figure 3:
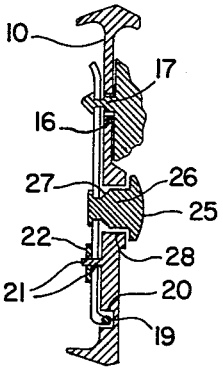
FIG. 3 is a cross-sectional view taken along line 3—3 of FIG. 2.

The split spring pin 18 is secured or retained in position along the back face of the buckle plate 10 by a pin 21 (FIG. 3) which is attached to the buckle plate 10 and extends between the two legs of the split spring pin 18. A circular retainer 22 is fit over and firmly attached to the free end of the pin 21 so that the legs of the split spring pin 18 can move in a restricted motion towards and away from each other in the space formed between the back face of the buckle plate 10 and the retainer 22. The split spring pin 18 can be removed and replaced in its operating position by simply forcing the legs of the split spring pin sufficiently apart so as to slide past the perimeter of the circular retainer 22.

Figure 5:
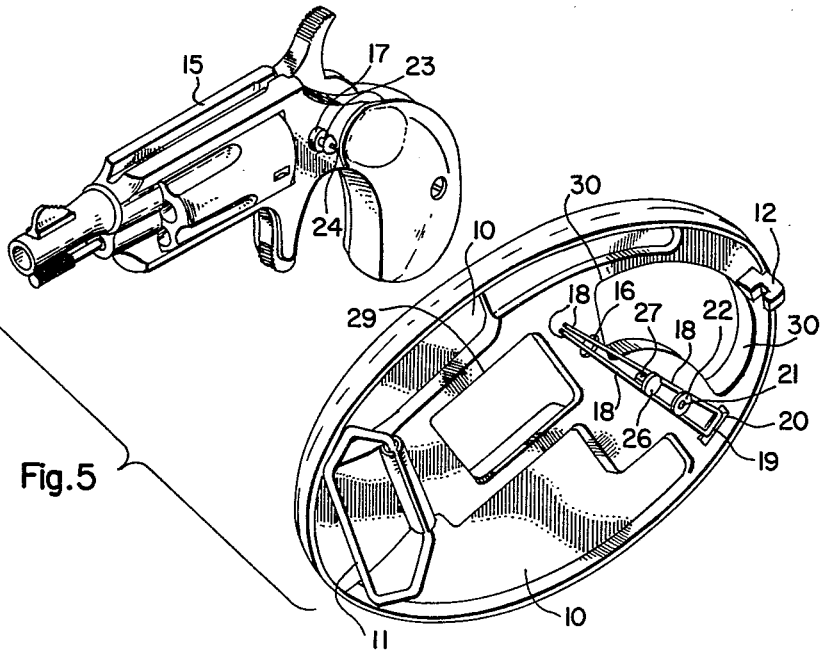
FIG. 5 is a pictorial view of the belt buckle of FIG. 1 looking from the rear of the buckle and with the handgun removed and shown in exploded perspective.

The stud 17 extending from the side plate of the handgun 15 has a conically-shaped free end with an annular groove 23 (FIG. 5) around the stud 17 adjacent to the conical end thereof. The conical end and the groove 23 of the stud 17 cooperate so that when the stud 17 is introduced into the opening 16 from the front face of the buckle plate 10, the conical end separates the two spring legs of the split spring pin 18, and the two spring legs then snap into and are engaged in the annular groove 23 so as to hold the stud 17 securely in place in the opening 16. As can be seen, when the stud 17 is retained within opening 16, the handgun 15 is securely received and held in the indented area 14 on the front face of the buckle plate 10, with the entire flatwise side of the gun opposite the side from which the stud 17 extends being exposed and facing outwardly from the front face of the buckle plate 10.

The stud 17 advantageously is formed in combination with the side plate retaining screw of the handgun 15. As such, a slot 24 is provided in the conical end of the stud for engagement by a screwdriver. The other end of the stud 17 screws into the frame of the gun and securely holds the side plate of the gun in place, with the conical end of the stud 17 extending substantially normally to the side plate.

Means for releasing the stud 17 from the split spring pin comprises a push button 25 on the front face of the buckle. The push button 25 has a substantially cylindrical shaft portion 26 which extends through a second opening 28 in the buckle plate 10. The second opening 28 is positioned in alignment with the wire spring legs of the split spring pin 18 and spaced from the first opening 16 in the buckle plate 10. The push button 25 is positioned so that the free end of the shaft portion 26 extends from the second opening 28 in the buckle plate 10 and between the two wire spring legs of the split spring pin 18. The free end of the shaft portion 26 has an annular recess 27 thereabout, and the push button 25 and its associated shaft 26 are held in place by the two legs of the split spring pin 18 which engage the recess 27 in the shaft 26. The side edge of the recess 27 closest to the button 25 is canted toward the button 25 so as to make a sloped, beveled or conical surface which by a cam action forces the two legs of the split spring pin 18 apart when the push button 25 is depressed. The other side edge of the recess 27 is flat and substantially normal to the axis of the shaft 26.

Figure 2:
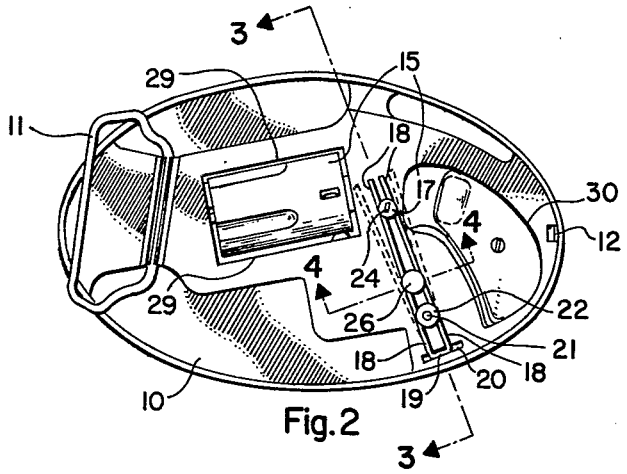
FIG. 2 is a rear elevation of the belt buckle of FIG. 1.

The button 25 and shaft 26 are positioned between the closed, or bent back portion of the split spring pin 18 and the opening 16 through which the stud 17 of the handgun 15 is received. Thus, as the cam action of the bevel in the recess 27 of the shaft 26 forces the two legs of the split spring pin 18 apart, as shown by dashed lines in FIG. 2, the stud 17 is released, and the handgun 15 can be removed from the indented area 14 in the buckle plate 10.

Figure 4A:
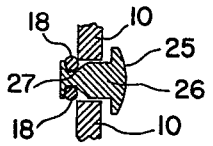
FIG. 4A is a partial cross-sectional view taken along line 4—4 of FIG. 2 showing the push button in its undepressed position.
Figure 4B:
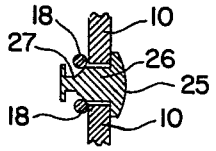
FIG. 4B is a view similar to that of FIG. 4A but showing the push button in its depressed position.

A partial cross-sectional view through the push button 25 and associated shaft 26 is illustrated in FIG. 4B, with the push button 25 shown in its depressed position. As shown, the legs of the split spring pin 18 are pushed out of the recess 27 and upwardly along the bevel of the inside surface of the recess 27. When the button 25 is released, the two legs of the split spring pin 18 bias the shaft 26 and button 25 to move to a position in which the button 25 extends outwardly from the front face of the buckle plate 10 as shown in FIG. 4A. With the push button 25 in its released position as shown in FIG. 4A, the two legs of the split spring pin 18 position themselves within the recess 27 and, thus, retain the shaft 26 within the aperture in the buckle plate 10 so that push button 25 does not become separated from the buckle plate 10.

To further facilitate receiving the handgun 15 flatwise within the indented area 14 of the buckle plate 10, cutout areas 29 and 30 can be provided in the indented area 14 of the buckle plate 10. The cutout areas 29 and 30 are sized and positioned so as to receive the respective sides of the cylinder and handgrip of the handgun 15 when the handgun is positioned within the indented area 14 of the buckle plate 10.

Although a preferred embodiment of the invention has been illustrated and described, it is to be understood that the present disclosure is made by way of example and that variations are possible without departing from the subject matter coming within the scope of the following claims, which subject matter I regard as my invention.

I claim:

1. A belt buckle adapted to have a small handgun releasably mounted to the front face thereof, said belt buckle comprising:

a buckle plate having an indented area on the front face thereof, said indented area being shaped for reception of a small handgun flatwise therein;

an opening in the indented portion of the buckle plate, said opening being adapted to receive a stud which is attached to and extends from the side frame of the handgun;

spring clasp means attached to the back face of said buckle plate and positioned adjacent to said opening, said spring clasp means being adapted to releasably engage the free end of said stud when said stud is received in said opening; and release means adapted to release said spring clasp means when it is desired to remove the gun from the buckle.

2. A belt buckle in accordance with claim 1, wherein said release means comprises a push button on the front face of the buckle which is biased by said spring clasp means to a positioned extending outwardly from said front face, said push button being further adapted to release said clasp means when said push button is depressed against the spring bias of said spring clasp means.

3. A belt buckle in accordance with claim 2, wherein said spring clasp means comprises a split spring pin formed from a wire spring which is bent back upon itself to provide two wire spring legs extending in parallel closely spaced relationship, said split spring pin being attached to the back face of said buckle plate so as to lie flat adjacent to said back face, with the two wire spring legs passing over said opening, and said stud on said gun has a conically-shaped free end with an annular groove around the stud adjacent to the conical end such that when said stud is introduced into said opening from the front face of said buckle plate, the conical end separates the two spring legs of the split spring pin and the two spring legs then engage the annular groove to hold the stud securely in place in said opening.

4. A belt buckle in accordance with claim 3, wherein said push button comprises a cylindrical shaft extending from said button and a second opening is provided in said indented portion of said buckle plate through which the cylindrical shaft extends, said second opening being in alignment with the two wire spring legs of said split spring pin and spaced from said first opening, said cylindrical shaft further having an annular recess thereabout adjacent to its end opposite said push button, said annular recess having a sloping, conical side towards said button and a substantially flat side adjacent to said opposite end of said cylindrical shaft, whereby the cylindrical shaft is retained in position in said second opening by positioning the two wire spring legs of said split spring pin in the annular recess on opposite sides of the cylindrical shaft and whereby when the button on the cylindrical shaft is depressed, the sloping, conical side of said annular recess forces the two wire spring legs apart so as to release the engagement of the two wire spring legs with the annular groove in the stud in said first opening.

5. A belt buckle as claimed in claim 4 in combination with a small handgun which has said stud extending from the side of said gun.

6. A belt buckle as claimed in claim 5, wherein cutout areas are provided in the indented area of the buckle plate which are adapted to receive the handle portion and the cylinder portion of the handgun.

* * * * *